US012382983B2

(12) United States Patent
Kabirat

(10) Patent No.: US 12,382,983 B2
(45) Date of Patent: Aug. 12, 2025

(54) AEROSOL GENERATION

(71) Applicant: Nicoventures Trading Limited, London (GB)

(72) Inventor: Junior Kabirat, London (GB)

(73) Assignee: Nicoventures Trading Limited, London (GB)

( * ) Notice: Subject to any disclaimer, the term of this patent is extended or adjusted under 35 U.S.C. 154(b) by 804 days.

(21) Appl. No.: 17/250,501

(22) PCT Filed: Jul. 31, 2019

(86) PCT No.: PCT/EP2019/070721
§ 371 (c)(1),
(2) Date: Jan. 28, 2021

(87) PCT Pub. No.: WO2020/025723
PCT Pub. Date: Feb. 6, 2020

(65) Prior Publication Data

US 2021/0307377 A1 Oct. 7, 2021

(30) Foreign Application Priority Data

Jul. 31, 2018 (GB) ..... 1812501

(51) Int. Cl.
*A24B 15/167* (2020.01)
*A24B 15/14* (2006.01)
(Continued)

(52) U.S. Cl.
CPC ..... *A24B 15/167* (2016.11); *A24B 15/14* (2013.01); *A24B 15/30* (2013.01); *A24D 1/20* (2020.01); *A24F 40/20* (2020.01)

(58) Field of Classification Search
CPC ..... A24B 15/167; A24B 15/30; A24D 1/20
See application file for complete search history.

(56) References Cited

U.S. PATENT DOCUMENTS

2004/0025894 A1* 2/2004 Beven ..... A24D 1/02 131/360
2011/0139669 A1* 6/2011 Huppert ..... A61L 9/042 206/524.1
(Continued)

FOREIGN PATENT DOCUMENTS

CA 2322640 A1 9/1999
CA 2956345 A1 2/2016
(Continued)

OTHER PUBLICATIONS

Cardboard definition "Cardboard." Vocabulary.com Dictionary, Vocabulary.com, https://www.vocabulary.com/dictionary/cardboard. Accessed May 1, 2024. (Year: 2024).*
(Continued)

*Primary Examiner* — Michael H. Wilson
*Assistant Examiner* — Stephanie Lynn Moore
(74) *Attorney, Agent, or Firm* — WOMBLE BOND DICKINSON (US) LLP

(57) ABSTRACT

A laminate aerosol generating material, wherein the material comprises an aerosol-forming layer (2) attached to a carrier layer (4), wherein the aerosol-forming layer (2) comprises an amorphous solid and wherein the carrier (4) comprises wood and/or cardboard.

15 Claims, 1 Drawing Sheet

(51) Int. Cl.

| | |
|---|---|
| ***A24B 15/30*** | (2006.01) |
| ***A24D 1/20*** | (2020.01) |
| ***A24F 40/20*** | (2020.01) |

(56) References Cited

U.S. PATENT DOCUMENTS

| | | | | |
|---|---|---|---|---|
| 2015/0209530 | A1 | 7/2015 | White | |
| 2017/0340003 | A1* | 11/2017 | Batista | A24F 40/46 |
| 2018/0125113 | A1* | 5/2018 | Minzoni | D21H 27/10 |

FOREIGN PATENT DOCUMENTS

| | | | | |
|---|---|---|---|---|
| CA | 2996625 | A1 | 3/2017 | |
| CA | 3021251 | A1 | 10/2017 | |
| CN | 107846963 | A | 3/2018 | |
| CN | 107874324 | A | 4/2018 | |
| CN | 107949283 | A | 4/2018 | |
| JP | H03175968 | A | 7/1991 | |
| JP | 2017501682 | A | 1/2017 | |
| RU | 2604313 | C2 | 12/2016 | |
| WO | 2011079933 | A1 | 7/2011 | |
| WO | 2015062983 | A2 | 5/2015 | |
| WO | WO2015071682 | A1 | 5/2015 | |
| WO | 2015165747 | A1 | 11/2015 | |
| WO | 2016005533 | A1 | 1/2016 | |
| WO | 2016135331 | A1 | 9/2016 | |
| WO | 2016156495 | A2 | 10/2016 | |
| WO | 2018122375 | A1 | 7/2018 | |
| WO | WO-2019185745 | A1 * | 10/2019 | A24D 1/20 |

OTHER PUBLICATIONS

"International Preliminary Report on Patentability received for PCT Patent Application No. PCT/EP2019/070721, mailed on Feb. 11, 2021", 7 pages.

International Search Report and Written Opinion, International Application No. PCT/EP2019/070721, mailing date Nov. 27, 2019, 12 pages.

* cited by examiner

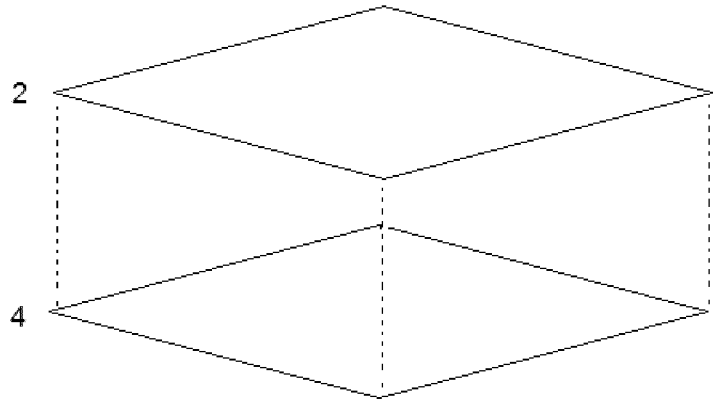
2
4

AEROSOL GENERATION

CROSS-REFERENCE TO RELATED APPLICATIONS

The present application is a National Phase entry of PCT Application No. PCT/EP2019/070721, filed Jul. 31, 2019, which claims priority from Great Britain Patent Application No. 1812501.3 filed Jul. 31, 2018, each of which is fully incorporated herein by reference.

TECHNICAL FIELD

The present invention relates to aerosol generation.

BACKGROUND

Smoking articles such as cigarettes, cigars and the like burn tobacco during use to create tobacco smoke. Alternatives to these types of articles release an inhalable aerosol or vapor by releasing compounds from a substrate material by heating without burning. These may be referred to as non-combustible smoking articles or aerosol generating assemblies.

One example of such a product is a heating device which release compounds by heating, but not burning, a solid aerosolizable material. This solid aerosolizable material may, in some cases, contain a tobacco material. The heating volatilizes at least one component of the material, typically forming an inhalable aerosol. These products may be referred to as heat-not-burn devices, tobacco heating devices or tobacco heating products. Various different arrangements for volatilizing at least one component of the solid aerosolizable material are known.

As another example, there are e-cigarette/tobacco heating product hybrid devices, also known as electronic tobacco hybrid devices. These hybrid devices contain a liquid source (which may or may not contain nicotine) which is vaporized by heating to produce an inhalable vapor or aerosol. The device additionally contains a solid aerosolizable material (which may or may not contain a tobacco material) and components of this material are entrained in the inhalable vapor or aerosol to produce the inhaled medium.

SUMMARY

A first aspect of the invention provides a laminate aerosol generating material, wherein the material comprises an aerosol-forming layer attached to a carrier layer, wherein the aerosol-forming layer comprises an amorphous solid and wherein the carrier comprises wood and/or cardboard.

A second aspect of the invention provides an aerosol generating assembly comprising a laminate aerosol generating material according to the first aspect of the invention and a heater configured to heat but not burn the aerosol generating material.

A third aspect of the invention provides an aerosol-generating article for use in an aerosol generating assembly, the article comprising a laminate aerosol generating material according to the first aspect.

A fourth aspect of the invention provides a method of making laminate aerosol generating material according to the first aspect. The method may comprise (a) forming a slurry comprising components of the amorphous solid or precursors thereof, (b) applying the slurry to the carrier, (c) setting the slurry to form a gel, and (d) drying to form an amorphous solid.

Further aspects of the invention described herein may provide the use of the laminate aerosol generating material, the aerosol generating article or the aerosol generating assembly, in the generation of an inhalable aerosol.

Further features and advantages of the invention will become apparent from the following description, given by way of example only, and with reference to the accompanying figures.

BRIEF DESCRIPTION OF THE DRAWINGS

FIG. 1 is an exploded schematic diagram of a laminate aerosol generating material.

DETAILED DESCRIPTION OF THE DRAWINGS

The aerosol-forming layer described herein comprises an "amorphous solid", which may alternatively be referred to as a "monolithic solid" (i.e. non-fibrous), or as a "dried gel". The amorphous solid is a solid material that may retain some fluid, such as liquid, within it. In some cases, the aerosol-forming layer comprises from about 50 wt %, 60 wt % or 70 wt % of amorphous solid, to about 90 wt %, 95 wt % or 100 wt % of amorphous solid. In some cases, the aerosol-forming layer consists of amorphous solid.

As described above, the invention provides a laminate aerosol generating material, wherein the material comprises an aerosol-forming layer attached to a carrier layer, wherein the aerosol-forming layer comprises an amorphous solid and wherein the carrier comprises wood and/or cardboard. FIG. 1 provides a schematic illustration of such a laminate material; the laminate structure (indicated by dotted lines) includes a carrier layer 4, and an amorphous solid layer 2.

The inventors have found that such a laminate material may be biodegradable and/or recyclable. In some cases, the carrier may substantially consist of or consist of wood and/or cardboard.

Further, in some cases such as those where the carrier layer comprises cardboard, the carrier is absorbent, and absorbs condensate that forms in the device in use, potentially improving hygiene.

In some cases, the carrier layer has a thickness of from about 1 mm to about 4 mm, suitably from about 1.5 mm, 2.0 mm or 2.5 mm to about 3.5 mm, 3.0 mm or 2.5 mm.

In some cases, the carrier has a rigidity of at least 70 mN, tested according to ISO 2493-1. The carrier may have a rigidity in the range of about 70 mN to about 2000 mN, suitably 100 mN to 1000 mN or 200 mN to 500 mN. Such a rigidity may ease handling and/or insertion into a device in use.

In some cases, the carrier layer comprises one or more hemp, balsa wood, wood pulp, sugarcane bagasse, straw, cotton, flax, kenaf, and abaca.

In some cases, the carrier has a density in the range of 220 $gm^{-2}$ to about 480 $gm^{-2}$, suitably 250 $gm^{-2}$ to about 450 $gm^{-2}$ or about 300 $gm^{-2}$ to about 350 $gm^{-2}$.

In some cases, the amorphous solid comprises 1-60 wt % of a gelling agent; and/or 5-80 wt % of an aerosol generating agent; and/or 10-60 wt % of one or more active substances and/or flavorants;

wherein these weights are calculated on a dry weight basis.

In some cases, the amorphous solid comprises 1-50 wt % of a gelling agent; and/or 5-80 wt % of an aerosol generating agent; and/or 10-60 wt % of a tobacco extract, nicotine and/or flavorants;

wherein these weights are calculated on a dry weight basis.

In some cases, the amorphous solid comprises from about 1 wt % to about 15 wt % (suitably 5-15 wt %) water, calculated on a wet weight basis. The possible compositions for the amorphous solid are discussed below in more detail.

In some cases, the laminate aerosol generating material may comprise one or more magnets which can be used to fasten the material to an induction heater in use.

In some cases, the laminate aerosol generating material may comprise embedded heating means, such as resistive or inductive heating elements. For example, the heating means may be embedded in the amorphous solid layer.

In some cases, the carrier layer may be substantially or wholly impermeable to gas and/or aerosol. This prevents aerosol or gas passage through the carrier, thereby controlling the flow and ensuring good delivery to the user. This can also be used to prevent condensation or other deposition in use of the gas/aerosol on, for example, the surface of a heater provided in an aerosol generating assembly. Thus, consumption efficiency and hygiene can be improved in some cases.

The carrier may be at least partially porous in the region of the surface abutting the amorphous solid layer. The inventors have found that such a carrier is particularly suitable for the present invention; the porous section of the carrier layer abuts the amorphous solid layer and forms a strong bond. The amorphous solid is formed by drying a gel and, without being limited by theory, it is thought that the slurry from which the gel is formed partially impregnates the porous material of the carrier so that when the gel sets and forms cross-links, the carrier is partially bound into the gel. This provides a strong binding between the gel and the carrier (and between the dried gel and the carrier).

Additionally, surface roughness may contribute to the strength of bond between the amorphous material and the carrier. The inventors have found that the paper roughness (for the surface abutting the carrier) may suitably be in the range of 50-1000 Bekk seconds, suitably 50-150 Bekk seconds, suitably 100 Bekk seconds (measured over an air pressure interval of 50.66-48.00 kPa). (A Bekk smoothness tester is an instrument used to determine the smoothness of a paper surface, in which air at a specified pressure is leaked between a smooth glass surface and a paper sample, and the time (in seconds) for a fixed volume of air to seep between these surfaces is the "Bekk smoothness".)

Conversely, the surface of the carrier facing away from the amorphous solid may be arranged in contact with the heater, and a smoother surface may provide more efficient heat transfer. Thus, in some cases, the carrier is disposed so as to have a rougher side abutting the amorphous material and a smoother side facing away from the amorphous material.

In one particular case, the carrier may itself be a laminate structure. For example, it may comprise a cardboard-backed foil; the cardboard layer abuts the amorphous solid layer and the properties discussed in the previous paragraphs are afforded by this abutment. The foil backing is substantially impermeable, providing control of the aerosol flow path. A metal foil backing may also serve to conduct heat to the amorphous solid.

In another case, the foil layer of the cardboard-backed foil abuts the amorphous solid. The foil is substantially impermeable, thereby preventing water provided in the amorphous solid to be absorbed into the paper which could weaken its structural integrity.

In some cases, the carrier is formed from or comprises metal foil, such as aluminum foil. A metallic carrier may allow for better conduction of thermal energy to the amorphous solid. Additionally, or alternatively, a metal foil may function as a susceptor in an induction heating system. In particular embodiments, the carrier comprises a metal foil layer and a support layer, such as cardboard. In these embodiments, the metal foil layer may have a thickness of less than 20 μm, such as from about lum to about 10 μm, suitably about 5 μm.

In some cases, the amorphous solid may have a thickness of about 0.015 mm to about 1.0 mm. Suitably, the thickness may be in the range of about 0.05 mm, 0.1 mm or 0.15 mm to about 0.5 mm or 0.3 mm. The inventors have found that a material having a thickness of 0.2 mm is particularly suitable. The amorphous solid may comprise more than one layer, and the thickness described herein refers to the aggregate thickness of those layers.

The inventors have established that if the amorphous solid is too thick, then heating efficiency is compromised. This adversely affects the power consumption in use. Conversely, if the amorphous solid is too thin, it is difficult to manufacture and handle; a very thin material is harder to cast and may be fragile, compromising aerosol formation in use.

The inventors have established that the amorphous solid thicknesses stipulated herein optimize the material properties in view of these competing considerations. The thickness stipulated herein is a mean thickness for the material. In some cases, the amorphous solid thickness may vary by no more than 25%, 20%, 15%, 10%, 5% or 1%.

Aerosol-Forming Material Composition

In some cases, the amorphous solid may comprise 1-60 wt % of a gelling agent wherein these weights are calculated on a dry weight basis.

Suitably, the amorphous solid may comprise from about 1 wt %, 5 wt %, 10 wt %, 15 wt %, 20 wt % or 25 wt % to about 60 wt %, 50 wt %, 45 wt %, 40 wt %, 35 wt %, 30 wt % or 27 wt % of a gelling agent (all calculated on a dry weight basis). For example, the amorphous solid may comprise 1-50 wt %, 5-40 wt %, 10-30 wt % or 15-27 wt % of a gelling agent.

In some embodiments, the gelling agent comprises a hydrocolloid. In some embodiments, the gelling agent comprises one or more compounds selected from the group comprising alginates, pectins, starches (and derivatives), celluloses (and derivatives), gums, silica or silicones compounds, clays, polyvinyl alcohol and combinations thereof. For example, in some embodiments, the gelling agent comprises one or more of alginates, pectins, hydroxyethyl cellulose, hydroxypropyl cellulose, carboxymethylcellulose, pullulan, xanthan gum guar gum, carrageenan, agarose, acacia gum, fumed silica, PDMS, sodium silicate, kaolin and polyvinyl alcohol. In some cases, the gelling agent comprises alginate and/or pectin, and may be combined with a setting agent (such as a calcium source) during formation of the amorphous solid. In some cases, the amorphous solid may comprise a calcium-crosslinked alginate and/or a calcium-crosslinked pectin.

In some embodiments, the gelling agent comprises alginate, and the alginate is present in the amorphous solid in an amount of from 10-30 wt % of the amorphous solid (calculated on a dry weight basis). In some embodiments, alginate is the only gelling agent present in the amorphous solid. In other embodiments, the gelling agent comprises alginate and at least one further gelling agent, such as pectin.

In some embodiments the amorphous solid may include gelling agent comprising carrageenan.

Suitably, the amorphous solid may comprise from about 5 wt %, 10 wt %, 15 wt %, or 20 wt % to about 80 wt %, 70 wt %, 60 wt %, 55 wt %, 50 wt %, 45 wt % 40 wt %, or 35 wt % of an aerosol generating agent (all calculated on a dry weight basis). The aerosol generating agent may act as a plasticizer. For example, the amorphous solid may comprise 10-60 wt %, 15-50 wt % or 20-40 wt % of an aerosol generating agent. In some cases, the aerosol generating agent comprises one or more compound selected from erythritol, propylene glycol, glycerol, triacetin, sorbitol and xylitol. In some cases, the aerosol generating agent comprises, consists essentially of or consists of glycerol. The inventors have established that if the content of the plasticizer is too high, the amorphous solid may absorb water resulting in a material that does not create an appropriate consumption experience in use. The inventors have established that if the plasticizer content is too low, the amorphous solid may be brittle and easily broken. The plasticizer content specified herein provides an amorphous solid flexibility which allows the amorphous solid sheet to be wound onto a bobbin, which is useful in manufacture of aerosol generating articles.

In some cases, the amorphous solid may comprise a flavor. Suitably, the amorphous solid may comprise up to about 60 wt %, 50 wt %, 40 wt %, 30 wt %, 20 wt %, 10 wt % or 5 wt % of a flavor. In some cases, the amorphous solid may comprise at least about 0.5 wt %, 1 wt %, 2 wt %, 5 wt % 10 wt %, 20 wt % or 30 wt % of a flavor (all calculated on a dry weight basis). For example, the amorphous solid may comprise 0.1-60 wt %, 1-60 wt %, 5-60 wt %, 10-60 wt %, 20-50 wt % or 30-40 wt % of a flavor. In some cases, the flavor (if present) comprises, consists essentially of or consists of menthol. In some cases, the amorphous solid does not comprise a flavor.

In some cases, the amorphous solid additionally comprises an active substance. For example, in some cases, the amorphous solid additionally comprises a tobacco material and/or nicotine. For example, the amorphous solid may additionally comprise powdered tobacco and/or nicotine and/or a tobacco extract. In some cases, the amorphous solid may comprise from about 1 wt %, 5 wt %, 10 wt %, 15 wt %, 20 wt % or 25 wt % to about 70 wt %, 50 wt %, 45 wt % or 40 wt % (calculated on a dry weight basis) of active substance. In some cases, the amorphous solid may comprise from about 1 wt %, 5 wt %, 10 wt %, 15 wt %, 20 wt % or 25 wt % to about 70 wt %, 60 wt %, 50 wt %, 45 wt % or 40 wt % (calculated on a dry weight basis) of a tobacco material and/or nicotine.

In some cases, the amorphous solid comprises an active substance such as tobacco extract. In some cases, the amorphous solid may comprise 5-60 wt % (calculated on a dry weight basis) of tobacco extract. In some cases, the amorphous solid may comprise from about 5 wt %, 10 wt %, 15 wt %, 20 wt % or 25 wt % to about 55 wt %, 50 wt %, 45 wt % or 40 wt % (calculated on a dry weight basis) tobacco extract. For example, the amorphous solid may comprise 5-60 wt %, 10-55 wt % or 25-55 wt % of tobacco extract. The tobacco extract may contain nicotine at a concentration such that the amorphous solid comprises 1 wt % 1.5 wt %, 2 wt % or 2.5 wt % to about 6 wt %, 5 wt %, 4.5 wt % or 4 wt % (calculated on a dry weight basis) of nicotine. In some cases, there may be no nicotine in the amorphous solid other than that which results from the tobacco extract.

In some embodiments the amorphous solid comprises no tobacco material but does comprise nicotine. In some such cases, the amorphous solid may comprise from about 1 wt %, 2 wt %, 3 wt % or 4 wt % to about 20 wt %, 15 wt %, 10 wt % or 5 wt % (calculated on a dry weight basis) of nicotine. For example, the amorphous solid may comprise 1-20 wt % or 2-5 wt % of nicotine.

In some cases, the total content of active substance and flavor may be at least about 0.1 wt %, 1 wt %, 5 wt %, 10 wt %, 20 wt %, 25 wt % or 30 wt %. In some cases, the total content of active substance and flavor may be less than about 80 wt %, 70 wt %, 60 wt %, 50 wt % or 40 wt % (all calculated on a dry weight basis).

The amorphous solid may, in some cases, be a hydrogel and comprises less than about 20 wt %, 15 wt %, 12 wt % or 10 wt % of water calculated on a wet weight basis (WWB). In some cases, the amorphous solid may comprise at least about 1 wt %, 2 wt % or 5 wt % of water (WWB). The amorphous solid comprises from about 1 wt % to about 15 wt % water, or from about 5 wt % to about 15 wt % calculated on a wet weight basis. Suitably, the water content of the amorphous solid may be from about 5 wt %, 7 wt % or 9 wt % to about 15 wt %, 13 wt % or 11 wt % (WWB), most suitably about 10 wt %.

The amorphous solid may be made from a gel, and this gel may additionally comprise a solvent, included at 0.1-50 wt %. However, the inventors have established that the inclusion of a solvent in which the flavor is soluble may reduce the gel stability and the flavor may crystalize out of the gel. As such, in some cases, the gel does not include a solvent in which the flavor is soluble.

In some embodiments, the amorphous solid comprises less than 60 wt % of a filler, such as from 1 wt % to 60 wt %, or 5 wt % to 50 wt %, or 5 wt % to 30 wt %, or 10 wt % to 20 wt %.

In other embodiments, the amorphous solid comprises less than 20 wt %, suitably less than 10 wt % or less than 5 wt % of a filler. In some cases, the amorphous solid comprises less than 1 wt % of a filler, and in some cases, comprises no filler.

The filler, if present, may comprise one or more inorganic filler materials, such as calcium carbonate, perlite, vermiculite, diatomaceous earth, colloidal silica, magnesium oxide, magnesium sulphate, magnesium carbonate, and suitable inorganic sorbents, such as molecular sieves. The filler may comprise one or more organic filler materials such as wood pulp, cellulose and cellulose derivatives. In some cases, the amorphous solid comprises less than 1 wt % of a filler, and in some cases, comprises no filler. In particular, in some cases, the amorphous solid comprises no calcium carbonate such as chalk.

In particular embodiments which include filler, the filler is fibrous. For example, the filler may be a fibrous organic filler material such as wood pulp, hemp fiber cellulose or cellulose derivatives. Without wishing to be bound by theory, it is believed that including fibrous filler in an amorphous solid may increase the tensile strength of the material.

In some embodiments, the amorphous solid does not comprise tobacco fibers. In particular embodiments, the amorphous solid does not comprise fibrous material.

In some embodiments, the aerosol generating material does not comprise tobacco fibers. In particular embodiments, the aerosol generating material does not comprise fibrous material.

In some embodiments, the aerosol generating substrate does not comprise tobacco fibers. In particular embodiments, the aerosol generating substrate does not comprise fibrous material.

In some embodiments, the aerosol generating article does not comprise tobacco fibers. In particular embodiments, the aerosol generating article does not comprise fibrous material.

The aerosol generating material comprising the amorphous solid may have any suitable area density, such as from 30 $g/m^2$ to 120 $g/m^2$. In some embodiments, aerosol generating material may have an area density of from about 30 to 70 $g/m^2$, or about 40 to 60 $g/m^2$. In some embodiments, the amorphous solid may have an area density of from about 80 to 120 $g/m^2$, or from about 70 to 110 $g/m^2$, or particularly from about 90 to 110 $g/m^2$.

In some examples, the amorphous solid in sheet form may have a tensile strength of from around 200 N/m to around 900 N/m. In some examples, such as where the amorphous solid does not comprise a filler, the amorphous solid may have a tensile strength of from 200 N/m to 400 N/m, or 200 N/m to 300 N/m, or about 250 N/m. In some examples, such as where the amorphous solid comprises a filler, the amorphous solid may have a tensile strength of from 600 N/m to 900 N/m, or from 700 N/m to 900 N/m, or around 800 N/m.

In some cases, the amorphous solid may consist essentially of, or consist of a gelling agent, an aerosol generating agent, an active substance (such as a tobacco material and/or a nicotine source), water, and optionally a flavor.

Aerosol Generating Article and Assembly

A second aspect of the invention provides an aerosol generating assembly comprising a laminate aerosol generating material according to the first aspect of the invention and a heater configured to heat but not burn the aerosol generating material.

In some cases, the heater may heat, without burning, the aerosolizable material to between 120° C. and 350° C. in use. In some cases, the heater may heat, without burning, the aerosolizable material to between 140° C. and 250° C. in use. In some cases in use, substantially all of the amorphous solid is less than about 4 mm, 3 mm, 2 mm or 1 mm from the heater. In some cases, the solid is disposed between about 0.010 mm and 2.0 mm from the heater, suitably between about 0.02 mm and 1.0 mm, suitably 0.1 mm to 0.5 mm. These minimum distances may, in some cases, reflect the thickness of a carrier that supports the amorphous solid. In some cases, a surface of the amorphous solid may directly abut the heater.

In some other cases, the laminate aerosol generating material may be included in sheet form. Suitably, the laminate aerosol generating material may be included as a planar sheet.

The heater is configured to heat not burn the laminate aerosol generating material. The heater may be, in some cases, a thin film, electrically resistive heater. In other cases, the heater may comprise an induction heater or the like. The heater may be a combustible heat source or a chemical heat source which undergoes an exothermic reaction to product heat in use. The aerosol generating assembly may comprise a plurality of heaters. The heater(s) may be powered by a battery.

The aerosol generating assembly may additionally comprise a cooling element and/or a filter. The cooling element, if present, may act or function to cool gaseous or aerosol components. In some cases, it may act to cool gaseous components such that they condense to form an aerosol. It may also act to space the very hot parts of the apparatus from the user. The filter, if present, may comprise any suitable filter known in the art such as a cellulose acetate plug.

In some cases, the aerosol generating assembly may be a heat-not-burn device. That is, it may contain a solid tobacco-containing material (and no liquid aerosolizable material). In some cases, the amorphous solid may comprise the tobacco material. A heat-not-burn device is disclosed in WO 2015/062983 A2, which is incorporated by reference in its entirety.

In some cases, the aerosol generating assembly may be an electronic tobacco hybrid device. That is, it may contain a solid aerosolizable material and a liquid aerosolizable material. In some cases, the amorphous solid may comprise nicotine. In some cases, the amorphous solid may comprise a tobacco material. In some cases, the amorphous solid may comprise a tobacco material and a separate nicotine source. The separate aerosolizable materials may be heated by separate heaters, the same heater or, in one case, a downstream aerosolizable material may be heated by a hot aerosol which is generated from the upstream aerosolizable material. An electronic tobacco hybrid device is disclosed in WO 2016/135331 A1, which is incorporated by reference in its entirety.

The invention also provides an aerosol generating article comprising an aerosol generating material according to the first aspect of the invention. The article may be adapted for use in a THP, an electronic tobacco hybrid device or another aerosol generating device. In some cases, the article may additionally comprise a filter and/or cooling element, as described previously. In some cases, the aerosol generating article may be circumscribed by a wrapping material such as paper.

The aerosol generating article or assembly may additionally comprise ventilation apertures. In the case of the article, these apertures may be provided in the sidewall of the article. In some cases, the ventilation apertures may be provided in the filter and/or cooling element. These apertures may allow cool air to be drawn into the article during use, which can mix with the heated volatilized components thereby cooling the aerosol.

The ventilation enhances the generation of visible heated volatilized components from the article when it is heated in use. The heated volatilized components are made visible by the process of cooling the heated volatilized components such that supersaturation of the heated volatilized components occurs. The heated volatilized components then undergo droplet formation, otherwise known as nucleation, and eventually the size of the aerosol particles of the heated volatilized components increases by further condensation of the heated volatilized components and by coagulation of newly formed droplets from the heated volatilized components.

In some cases, the ratio of the cool air to the sum of the heated volatilized components and the cool air, known as the ventilation ratio, is at least 15%. A ventilation ratio of 15% enables the heated volatilized components to be made visible by the method described above. The visibility of the heated volatilized components enables the user to identify that the volatilized components have been generated and adds to the sensory experience of the smoking experience.

In another example, the ventilation ratio is between 50% and 85% to provide additional cooling to the heated volatilized components. In some cases, the ventilation ratio may be at least 60% or 65%.

Method of Manufacture

A fourth aspect of the invention provides a method of making laminate aerosol generating material according to the first aspect.

The method may comprise (a) forming a slurry comprising components of the amorphous solid or precursors thereof, (b) applying the slurry to the carrier, (c) setting the slurry to form a gel, and (d) drying to form an amorphous solid.

The step (b) of applying the slurry to the carrier may comprise spraying, casting or extruding the slurry, for example. In some cases, the slurry is applied by electrospraying the slurry. In some cases, the slurry is applied by casting the slurry.

In some cases, the steps (b) and/or (c) and/or (d) may, at least partially, occur simultaneously (for example, during electrospraying). In some cases, these steps may occur sequentially.

In some examples, the slurry has a viscosity of from about 10 to about 20 Pa·s at 46.5° C., such as from about 14 to about 16 Pa·s at 46.5° C.

The step (c) of setting the gel may comprise the addition of a setting agent to the slurry. For example, the slurry may comprise sodium, potassium or ammonium alginate as a gel-precursor, and a setting agent comprising a calcium source (such as calcium chloride), may be added to the slurry to form a calcium alginate gel.

The total amount of the setting agent, such as a calcium source, may be 0.5-5 wt % (calculated on a dry weight basis). The inventors have found that the addition of too little setting agent may result in a gel which does not stabilize the gel components and results in these components dropping out of the gel. The inventors have found that the addition of too much setting agent results in a gel that is very tacky and consequently has poor handleability.

Alginate salts are derivatives of alginic acid and are typically high molecular weight polymers (10-600 kDa). Alginic acid is a copolymer of β-D-mannuronic (M) and α-L-guluronic acid (G) units (blocks) linked together with (1,4)-glycosidic bonds to form a polysaccharide. On addition of calcium cations, the alginate crosslinks to form a gel. The inventors have determined that alginate salts with a high G monomer content more readily form a gel on addition of the calcium source. In some cases therefore, the gel-precursor may comprise an alginate salt in which at least about 40%, 45%, 50%, 55%, 60% or 70% of the monomer units in the alginate copolymer are α-L-guluronic acid (G) units.

The slurry may be applied to the carrier by, for example, casting. In some cases, it may be case to a thickness of 1 mm to 3 mm, suitably 2 mm, and allowed to set to form a gel. The drying step may cause the material thickness to reduce by at least 80%, suitably 85% or 87%. For instance, the slurry may be cast at a thickness of 2 mm, and the resulting dried amorphous solid material may have a thickness of 0.2 mm.

The slurry itself may also form part of the invention. In some cases, the slurry solvent may consist essentially of or consist of water. In some cases, the slurry may comprise from about 50 wt %, 60 wt %, 70 wt %, 80 wt % or 90 wt % of solvent (WWB).

In cases where the solvent consists of water, the dry weight content of the slurry may match the dry weight content of the amorphous solid. Thus, the discussion herein relating to the solid composition is explicitly disclosed in combination with the slurry aspect of the invention.

EXEMPLARY EMBODIMENTS

In some embodiments, the amorphous solid comprises menthol.

In some such embodiments, the amorphous solid may have the following composition (DWB): gelling agent (preferably comprising alginate, more preferably comprising a combination of alginate and pectin) in an amount of from about 20 wt % to about 40 wt %, or about 25 wt % to 35 wt %; menthol in an amount of from about 35 wt % to about 60 wt %, or from about 40 wt % to 55 wt %; aerosol generating agent (preferably comprising glycerol) in an amount of from about 10 wt % to about 30 wt %, or from about 15 wt % to about 25 wt % (DWB).

In one embodiment, the amorphous solid comprises about 32-33 wt % of an alginate/pectin gelling agent blend; about 47-48 wt % menthol flavorant; and about 19-20 wt % glycerol aerosol generating agent (DWB).

The amorphous solid of these embodiments may have any suitable water content. For example, the amorphous solid may have a water content of from about 2 wt % to about 10 wt %, or from about 5 wt % to about 8 wt %, or about 6 wt %.

Suitably, the amorphous solid may be provided as a sheet having a thickness of from about 0.015 mm to about 1 mm, preferably from about 0.02 mm to about 0.07 mm.

In further embodiments, the amorphous solid may have the following composition (DWB): gelling agent (preferably comprising alginate, more preferably comprising a combination of alginate and pectin) in an amount of from about 5 wt % to about 40 wt %, or about 10 wt % to 30 wt %; menthol in an amount of from about 10 wt % to about 50 wt %, or from about 15 wt % to 40 wt %; aerosol generating agent (preferably comprising glycerol) in an amount of from about 5 wt % to about 40 wt %, or from about 10 wt % to about 35 wt %; and optionally filler in an amount of up to 60 wt %—for example, in an amount of from 5 wt % to 20 wt %, or from about 40 wt % to 60 wt % (DWB).

In one of these embodiments, the amorphous solid comprises about 11 wt % of an alginate/pectin gelling agent blend, about 56 wt % woodpulp filler, about 18% menthol flavorant and about 15 wt % glycerol (DWB).

In another of these embodiments, the amorphous solid comprises about 22 wt % of an alginate/pectin gelling agent blend, about 12 wt % woodpulp filler, about 36% menthol flavorant and about 30 wt % glycerol (DWB).

In some further embodiments, the amorphous solid comprises a flavorant which does not comprise menthol. In these embodiments, the amorphous solid may have the following composition (DWB): gelling agent (preferably comprising alginate) in an amount of from about 5 to about 40 wt %, or from about 10 wt % to about 35 wt %, or from about 20 wt % to about 35 wt %; flavorant in an amount of from about 0.1 wt % to about 40 wt %, of from about 1 wt % to about 30 wt %, or from about 1 wt % to about 20 wt %, or from about 5 wt % to about 20 wt %; aerosol generating agent (preferably comprising glycerol) in an amount of from 15 wt % to 75 wt %, or from about 30 wt % to about 70 wt %, or from about 50 wt % to about 65 wt %; and optionally filler (suitably woodpulp) in an amount of less than about 60 wt %, or about 20 wt %, or about 10 wt %, or about 5 wt % (preferably the amorphous solid does not comprise filler) (DWB).

In one of these embodiments, the amorphous solid comprises about 27 wt % alginate gelling agent, about 14 wt % flavorant and about 57 wt % glycerol aerosol generating agent (DWB).

In another of these embodiments, the amorphous solid comprises about 29 wt % alginate gelling agent, about 9 wt % flavorant and about 60 wt % glycerol (DWB).

In yet further embodiments, the amorphous solid comprises tobacco extract. In these embodiments, the amorphous solid may have the following composition (DWB): gelling agent (preferably comprising alginate) in an amount of from about 5 wt % to about 40 wt %, or about 10 wt % to 30 wt %, or about 15 wt % to about 25 wt %; tobacco extract in an amount of from about 30 wt % to about 60 wt %, or from about 40 wt % to 55 wt %, or from about 45 wt % to about 50 wt %; aerosol generating agent (preferably comprising glycerol) in an amount of from about 10 wt % to about 50 wt %, or from about 20 wt % to about 40 wt %, or from about 25 wt % to about 35 wt % (DWB).

In one embodiment, the amorphous solid comprises about 20 wt % alginate gelling agent, about 48 wt % Virginia tobacco extract and about 32 wt % glycerol (DWB).

The amorphous solid of these embodiments may have any suitable water content. For example, the amorphous solid may have a water content of from about 5 wt % to about 15 wt %, or from about 7 wt % to about 13 wt %, or about 10 wt %.

Suitably, in any of these embodiments containing tobacco-extract, the amorphous solid has a thickness of from about 50 μm to about 200 μm, or about 50 μm to about 100 μm, or about 60 μm to about 90 μm, suitably about 77 μm.

The slurry for forming this amorphous solid may also form part of the invention. In some cases, the slurry may have an elastic modulus of from about 5 to 1200 Pa (also referred to as storage modulus); in some cases, the slurry may have a viscous modulus of about 5 to 600 Pa (also referred to as loss modulus).

Definitions

The active substance as used herein may be a physiologically active material, which is a material intended to achieve or enhance a physiological response. The active substance may for example be selected from nutraceuticals, nootropics, psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, *cannabis* or another botanical.

In some embodiments, the active substance comprises nicotine.

In some embodiments, the active substance comprises caffeine, melatonin or vitamin B12.

As noted herein, the active substance may comprise one or more constituents, derivatives or extracts of *cannabis*, such as one or more cannabinoids or terpenes.

Cannabinoids are a class of natural or synthetic chemical compounds which act on cannabinoid receptors (i.e., CB1 and CB2) in cells that repress neurotransmitter release in the brain. Cannabinoids may be naturally occurring (phytocannabinoids) from plants such as *cannabis*, from animals (endocannabinoids), or artificially manufactured (synthetic cannabinoids). *Cannabis* species express at least 85 different phytocannabinoids, and are divided into subclasses, including cannabigerols, cannabichromenes, cannabidiols, tetrahydrocannabinols, cannabinols and cannabinodiols, and other cannabinoids. Cannabinoids found in *cannabis* include, without limitation: cannabigerol (CBG), cannabichromene (CBC), cannabidiol (CBD), tetrahydrocannabinol (THC), cannabinol (CBN), cannabinodiol (CBDL), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabinerolic acid, cannabidiolic acid (CBDA), Cannabinol propyl variant (CBNV), cannabitriol (CBO), tetrahydrocannabmolic acid (THCA), and tetrahydrocannabivarinic acid (THCV A).

As noted herein, the active substance may comprise or be derived from one or more botanicals or constituents, derivatives or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, *eucalyptus*, star anise, hemp, cocoa, *cannabis*, fennel, lemongrass, peppermint, spearmint, rooibos, chamomile, flax, ginger, *Ginkgo biloba*, hazel, hibiscus, laurel, licorice (liquorice), matcha, mate, orange skin, *papaya*, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, *curcuma*, turmeric, sandalwood, cilantro, bergamot, orange blossom, myrtle, cassis, valerian, pimento, mace, damien, marjoram, olive, lemon balm, lemon basil, chive, *carvi, verbena*, tarragon, geranium, mulberry, *ginseng*, theanine, theacrine, maca, ashwagandha, damiana, guarana, chlorophyll, baobab or any combination thereof. The mint may be chosen from the following mint varieties: *Mentha arvensis, Mentha* c.v., *Mentha niliaca, Mentha piperita, Mentha piperita citrata* c.v., *Mentha piperita* c.v., *Mentha spicata crispa, Mentha cordifolia, Mentha longifolia, Mentha suaveolens variegata, Mentha pulegium, Mentha spicata* c.v. and *Mentha suaveolens.*

In some embodiments, the botanical is selected from *eucalyptus*, star anise, cocoa and hemp.

In some embodiments, the botanical is selected from rooibos and fennel.

As used herein, the terms "flavor" and "flavorant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, *cannabis*, licorice (liquorice), *hydrangea*, eugenol, Japanese white bark *magnolia* leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, *papaya*, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, *betel*, shisha, pine, honey essence, rose oil, vanilla, lemon oil, orange oil, orange blossom, cherry blossom, *cassia*, caraway, cognac, jasmine, ylang-ylang, sage, fennel, wasabi, piment, ginger, coriander, coffee, hemp, a mint oil from any species of the genus *Mentha, eucalyptus*, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, *curcuma*, cilantro, myrtle, cassis, valerian, pimento, mace, damien, marjoram, olive, lemon balm, lemon basil, chive, *carvi, verbena*, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

The flavor may suitably comprise one or more mint-flavors suitably a mint oil from any species of the genus *Mentha*. The flavor may suitably comprise, consist essentially of or consist of menthol.

In some embodiments, the flavor comprises menthol, spearmint and/or peppermint.

In some embodiments, the flavor comprises flavor components of cucumber, blueberry, citrus fruits and/or redberry.

In some embodiments, the flavor comprises eugenol.

In some embodiments, the flavor comprises flavor components extracted from tobacco.

In some embodiments, the flavor comprises flavor components extracted from *cannabis*.

In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucalyptol, WS-3.

As used herein, the term "aerosol generating agent" refers to an agent that promotes the generation of an aerosol. An aerosol generating agent may promote the generation of an aerosol by promoting an initial vaporization and/or the condensation of a gas to an inhalable solid and/or liquid aerosol.

Suitable aerosol generating agents include, but are not limited to: a polyol such as erythritol, sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate. The aerosol generating agent may suitably have a composition that does not dissolve menthol. The aerosol generating agent may suitably comprise, consist essentially of or consist of glycerol.

As used herein, the term "tobacco material" refers to any material comprising tobacco or derivatives therefore. The term "tobacco material" may include one or more of tobacco, tobacco derivatives, expanded tobacco, reconstituted tobacco or tobacco substitutes. The tobacco material may comprise one or more of ground tobacco, tobacco fiber, cut tobacco, extruded tobacco, tobacco stem, reconstituted tobacco and/or tobacco extract.

The tobacco used to produce tobacco material may be any suitable tobacco, such as single grades or blends, cut rag or whole leaf, including Virginia and/or Burley and/or Oriental. It may also be tobacco particle 'fines' or dust, expanded tobacco, stems, expanded stems, and other processed stem materials, such as cut rolled stems. The tobacco material may be a ground tobacco or a reconstituted tobacco material. The reconstituted tobacco material may comprise tobacco fibers, and may be formed by casting, a Fourdrinier-based paper making-type approach with back addition of tobacco extract, or by extrusion.

All percentages by weight described herein (denoted wt %) are calculated on a dry weight basis, unless explicitly stated otherwise. All weight ratios are also calculated on a dry weight basis. A weight quoted on a dry weight basis refers to the whole of the extract or slurry or material, other than the water, and may include components which by themselves are liquid at room temperature and pressure, such as glycerol. Conversely, a weight percentage quoted on a wet weight basis refers to all components, including water.

For the avoidance of doubt, where in this specification the term "comprises" is used in defining the invention or features of the invention, embodiments are also disclosed in which the invention or feature can be defined using the terms "consists essentially of" or "consists of" in place of "comprises". Reference to a material "comprising" certain features means that those features are included in, contained in, or held within the material.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A laminate aerosol generating material, wherein the material comprises an aerosol-forming layer attached to a carrier layer, wherein the aerosol-forming layer comprises an amorphous solid and wherein the carrier comprises wood and/or cardboard, and wherein the carrier layer has a thickness of from about 1 mm to about 4 mm.

2. A laminate aerosol generating material according to claim 1, wherein the carrier has a rigidity of at least 70 mN, tested according to ISO 2493-1.

3. An aerosol generating material according to claim 1, wherein the carrier layer comprises one or more hemp, balsa wood, wood pulp, sugarcane bagasse, straw, cotton, flax, kenaf, and abaca.

4. An aerosol generating material according to claim 1, wherein the carrier has a density in the range of 220 $gm^{-2}$ to about 480 $gm^{-2}$.

5. An aerosol generating material according to claim 1, wherein the amorphous solid comprises:

1-60 wt % of a gelling agent; and/or 5-80 wt % of an aerosol generating agent; and/or 10-60 wt % of at least one active substance and/or flavorant; wherein these weights are calculated on a dry weight basis.

6. An aerosol generating material according to claim 1, wherein the amorphous solid comprises from about 1 wt % to about 20 wt % water, calculated on a wet weight basis.

7. An aerosol-generating article for use in an aerosol generating assembly, the article comprising a laminate aerosol generating material according to claim 1.

8. A laminate aerosol generating material according to claim 1, wherein the carrier comprises cardboard.

9. An aerosol generating assembly comprising a laminate aerosol generating material according to claim 1 and a heater configured to heat but not burn the aerosol generating material.

10. An aerosol generating assembly according to claim 9, wherein the assembly is a heat-not-burn device.

11. An aerosol generating assembly according to claim 9, wherein the assembly is an electronic tobacco hybrid device.

12. A laminate aerosol generating material, wherein the material comprises an aerosol-forming layer attached to a carrier layer, wherein the aerosol-forming layer comprises an amorphous solid and wherein the carrier comprises wood and/or cardboard, wherein the carrier has a rigidity of at least 70 mN, tested according to ISO 2493-1.

13. A method of making laminate aerosol generating material according to claim 1.

14. A method according to claim 13, the method comprising (a) forming a slurry comprising components of the amorphous solid or precursors thereof, (b) applying the slurry to the carrier, (c) setting the slurry to form a gel, and (d) drying the gel to form an amorphous solid.

15. A method according to claim 14, wherein (c) comprises the addition of a setting agent to the slurry.

* * * * *